US006331125B1

(12) United States Patent
Lin

(10) Patent No.: US 6,331,125 B1
(45) Date of Patent: Dec. 18, 2001

(54) STRUCTURE OF A CONNECTOR FOR COMPUTER PERIPHERAL DEVICES

(76) Inventor: Liken Lin, 35 Chung Yang Rd., Sec. 4, Tu-Cheng, Taipei Hsien (TW)

( * ) Notice: Subject to any disclaimer, the term of this patent is extended or adjusted under 35 U.S.C. 154(b) by 0 days.

(21) Appl. No.: 09/517,723

(22) Filed: Mar. 2, 2000

(51) Int. Cl.[7] ..... H01R 13/64
(52) U.S. Cl. ..... 439/660; 439/247
(58) Field of Search ..... 439/733.1, 79, 439/83, 682, 660, 246–248

(56) References Cited

U.S. PATENT DOCUMENTS 5,586,915 * 12/1996 Baker et al. ..... 439/733.1

* cited by examiner

*Primary Examiner*—Gary Paumen
(74) *Attorney, Agent, or Firm*—Jacobson Holman, PLLC

(57) ABSTRACT

An improved structure of connector for peripheral devices comprises a housing and a plurality of terminals while a number of passages are disposed longitudinally at the rear side of the housing for insertion of the terminals respectively. The features of the present invention include: The side-view of the front part of the terminal is V-shaped and the enlarged body portion of terminal is mounted into the passages and the leg of terminal extending rearwardly from the rear side of the body portion is welded to the rear side of the housing. With the foregoing structure, the anti-bent ability of terminal is increased due to the enlarged body portion mounted into the passages and only the leg exposed outside the housing. In addition, the distance between adjacent terminal legs is apparent longer than the distance between adjacent terminals of the prior art thus the short caused by electrical arc effect originating from the short distance between two terminals under the high-voltage situation can be prevented.

3 Claims, 4 Drawing Sheets

STRUCTURE OF A CONNECTOR FOR COMPUTER PERIPHERAL DEVICES

BACKGROUND OF THE INVENTION

1. Field of the Invention

The present invention generally relates to an improved structure of connectors, and particularly to an improved terminal of connectors which has the enlarged body portion mounted into the terminal-receiving passages for avoiding the bent of terminals and the distance between the two adjacent legs of terminals is longer than the distance between the two adjacent terminals of the prior art so that the electrical arc causing the short can be avoided.

2. Description of the Related Art

The structure of conventional connectors (shown in FIG. 4) comprises a housing(a) mounted with a plurality of longitudinal terminal-receiving passages (b). A large number of terminals(c) are inserted into the respective terminal-receiving passages (b) from the rear wall of the housing(a). The housing(a) is fixed by the combination of front shield(d) and rear shield(e). The sectional view of the front part of the terminal(c) is V-shaped. The rear part of the terminal(c) has an enlarged body portion(cl) projecting laterally outwardly from opposite edges disposed outside the terminal-receiving passages (b) and a leg(f) portion of terminal extending rearwardly from the rear side of the body portion(cl) for connecting with the PCB circuit board.

When the leg(f) is welded onto the circuit board, the enlarged body portion(cl) and the leg(f) is exposed outside the housing(a) and the area of the body portion(cl) is larger than the area of the terminal(c) inside the housing(a). Therefore, due to the stress concentration, the leg(f) outside the terminal(c) bent and deformed easily and caused the connectors bad contact which has effect on the function of the terminal(c) or even a breakdown.

In addition, the distance between the adjacent body portion(cl) of terminals inside the housing(a) is so close that the electrical arc will be produced which can cause the short of all terminals(c) as the device is used on the high voltage situation. Then the connectors and the corresponding plugs are also damaged and even cause the fire on electric wires. The present invention is directed to solve the above problems and satisfying the need for an effective connector.

SUMMARY OF THE INVENTION

The primary object, therefore, of the invention is to provide an improved structure of a connector for peripheral devices. The enlarged body portion of the terminal is mounted into the housing so that only the leg portion of the terminal exposed outside the housing and the anti-bent ability of the terminal leg thus increases.

Another feature of the present invention is the distance between the adjacent terminal legs is longer than that of the prior art, which can prevent terminals from electrical arc and short.

BRIEF DESCRIPTION OF THE DRAWINGS

The accomplishment of the above-mentioned objects of the present invention will become apparent from the following description and its accompanying drawings which disclose the present invention and are as follows.

DETAILED DESCRIPTION OF THE PREFERRED EMBODIMENT

Figure 1:
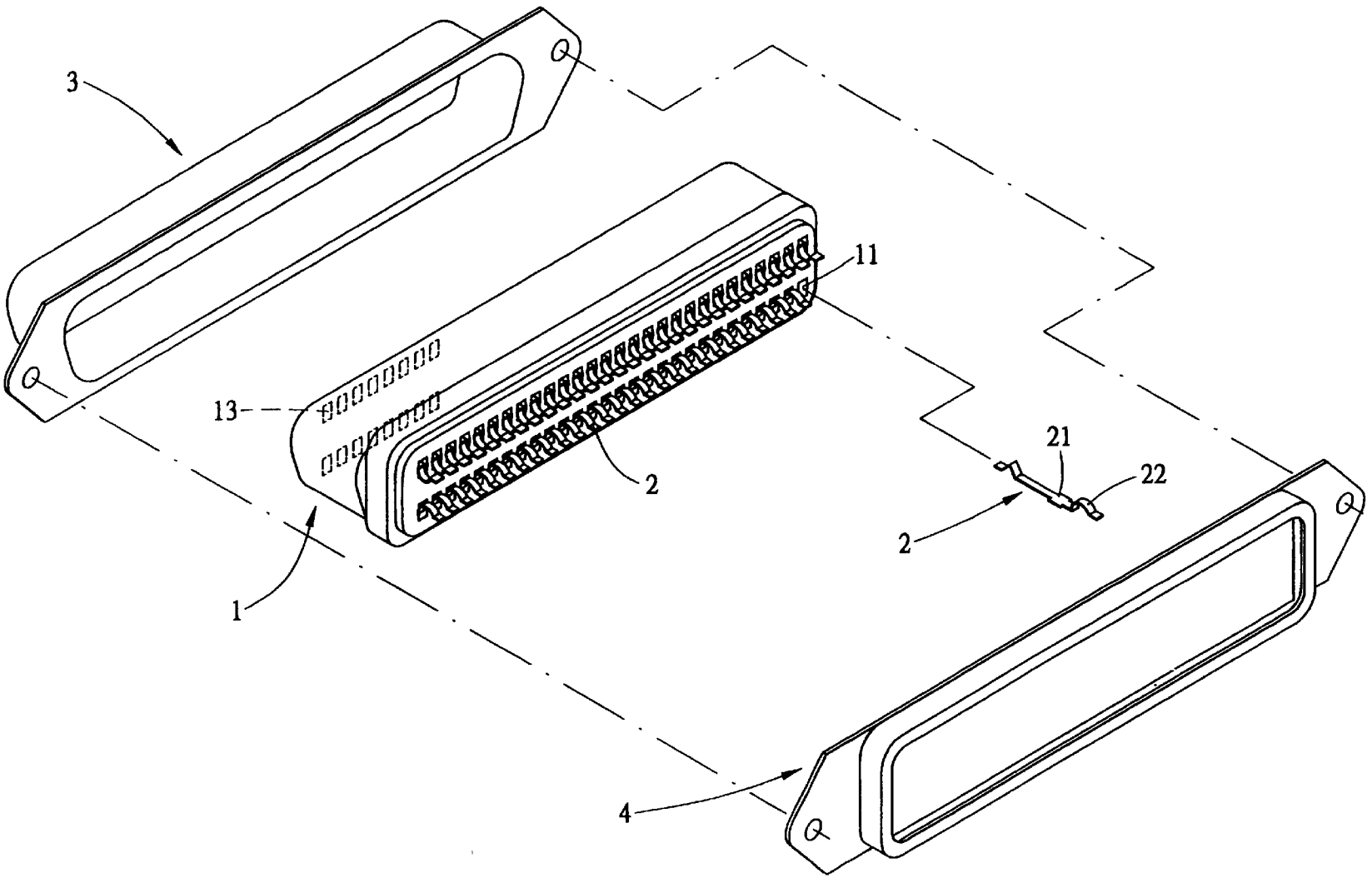
FIG. 1 the assembly view of the present invention
Figure 2:
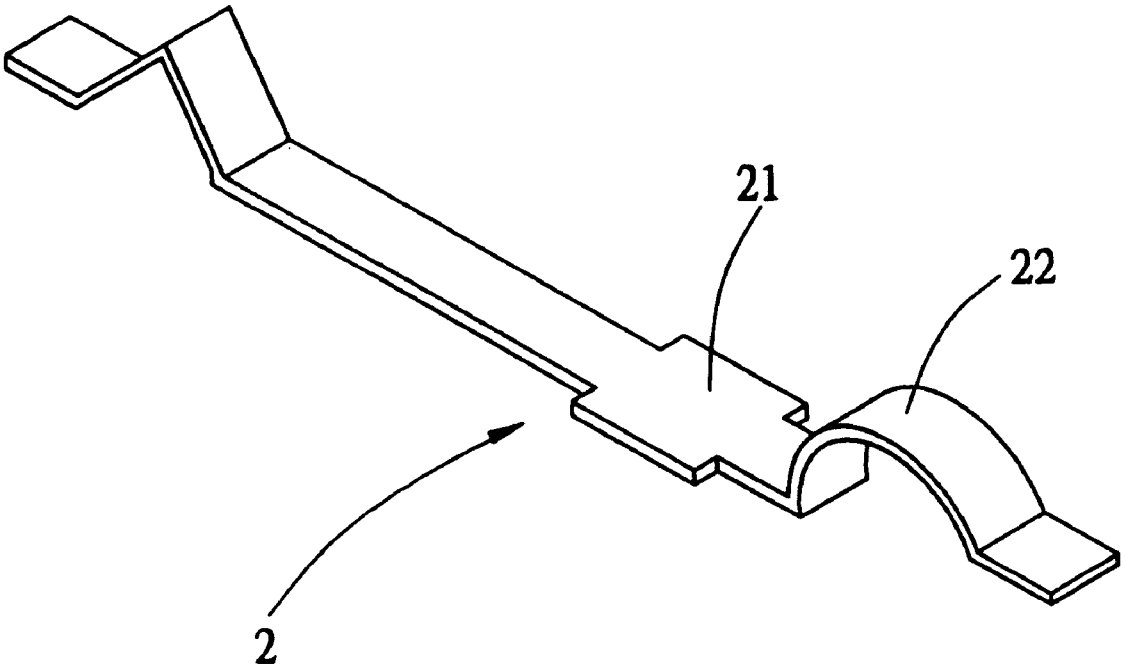
FIG. 2 the perspective view of the terminal
Figure 3:
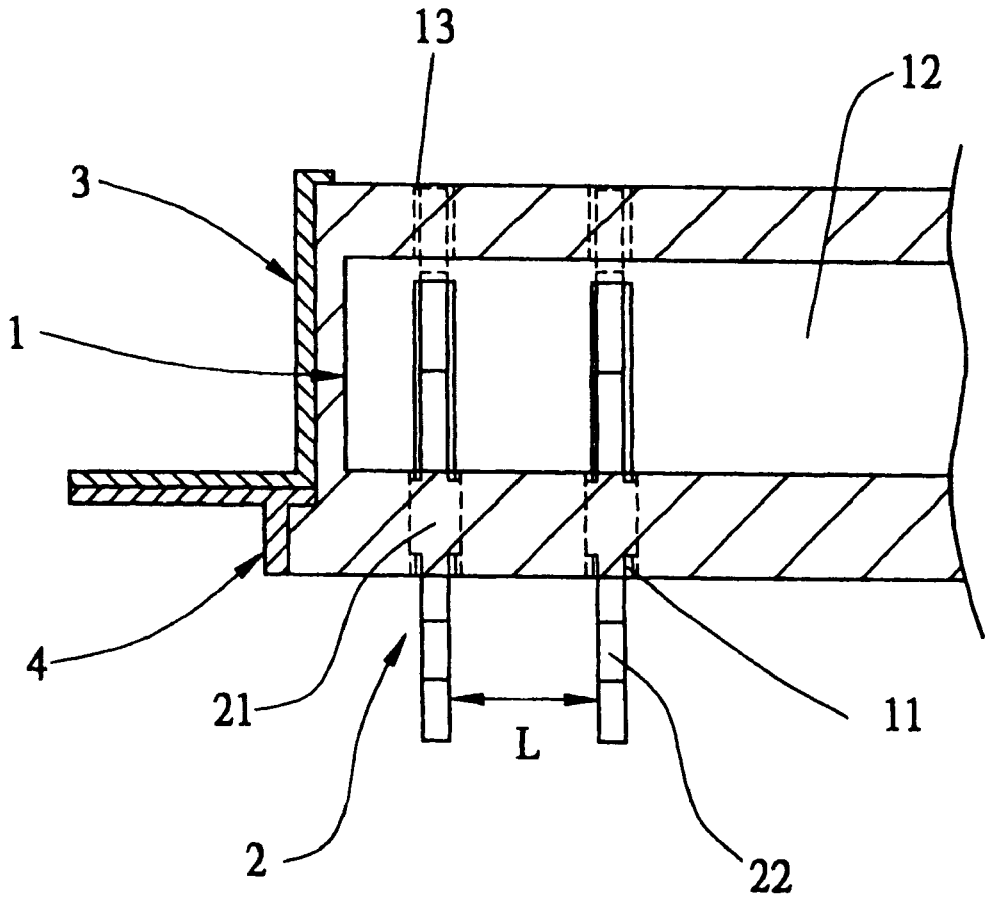
FIG. 3 the sectional view of the present invention
Figure 4:
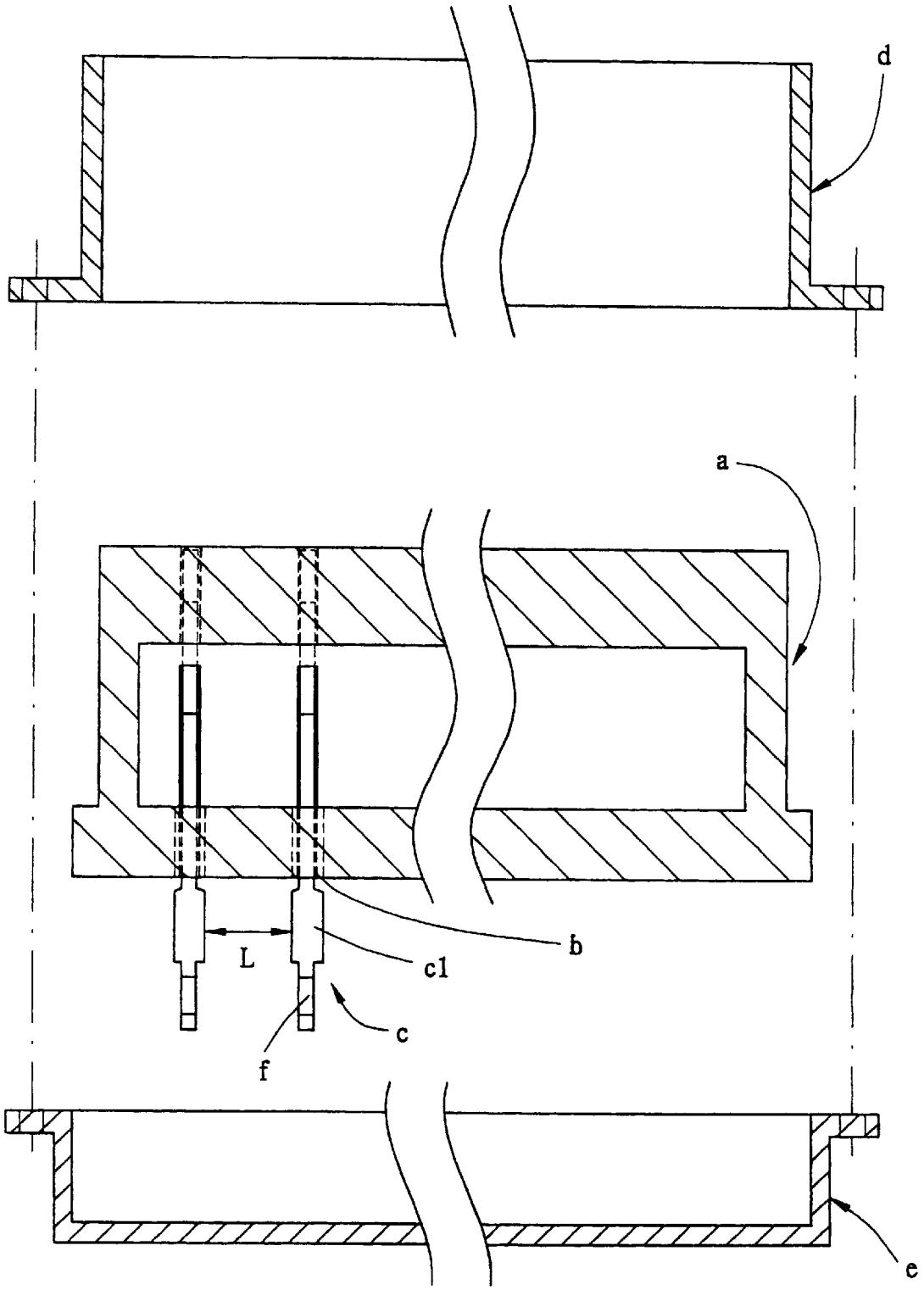
FIG. 4 the sectional view of the conventional connector and terminal.

Referring to the FIGS. 1–3, the invention comprises a housing (1) of connector, a plurality of terminals (2), front shield (3) and rear shield (4) therein. A groove (12) is mounted in the housing with a plurality of terminal-receiving passages (11) longitudinally in the rear side and a number of holes(13) in the front side. The holes(13) are corresponding to the passages (11) which are mounted with terminals respectively. The terminal (2) is inserted into the passage (11) longitudinally from the rear side of the housing (1) and the front part of the terminal is fitted to the holes(13) on the front side of the housing(1). And then the front shield (3) and the rear shield (4) are connected to the front side and rear side of the housing(1) respectively. The side view of the front part of the terminal (2) is V-shaped and the enlarged body portion(21) is mounted into the passages(11) and the leg(22) of terminal(2) extending rearwardly from the rear side of the body portion(21) is welded to the rear side of the housing(1).

With the above structural combination, the enlarged body portion(21) of the terminal(2) is inserted into the passage (11) of the housing(1) so that only the leg(22) of the terminal exposed outside the housing. Therefore, the anti-bent ability of the terminal (2) is increased due to the avoidance of stress concentration. And the deformation of the terminal (2) caused by the improper operation when being welded onto the PCB circuit board can also be avoided.

In addition, when the terminal(2) is mounted into the housing(1), the distance between adjacent terminal legs(22) is apparent longer than the distance between adjacent terminals of the prior art. Therefore, under the high-voltage situation, the present invention can avoid the short caused by electrical arc effect and further prevent the housing of connector and plugs from damage.

What is claimed is:

1. A connector for a peripheral device comprising:

a housing;

a front side of said housing having a plurality of equally spaced front holes;

a rear side of said housing having a plurality of equally spaced longitudinally passages for insertion of terminals, each said plurality of equally spaced longitudinal passages corresponding to one of said plurality of equally spaced front holes, and each of said plurality of equally spaced longitudinal passages being larger in width than the corresponding front hole; and a plurality of terminals for inserting into the corresponding one of said plurality of equally spaced longitudinal passages, each of said plurality of terminals having a front V-shaped part, a rear curved leg and an enlarged body portion, said front part and rear leg being equal in width, said enlarged body portion of said terminal and said longitudinal passage being equal in width for mounting into each of the passages with said front V-shaped part entering said passage and extending to said front hole, said enlarged body portion completely and snuggly fitting in said corresponding passage, and said rear curved leg extending rearwardly from the enlarged body portion for connecting to the rear side of the housing, and only said rear curved leg being exposed outside the housing.

2. The connector for the peripheral device as claimed in claim 1, wherein said enlarged body portion is symmetrical.

3. The connector for the peripheral device as claimed in claim 1, wherein said enlarged body portion determines the spacing of the passages along the rear side of the housing and with each rear curved leg being spaced an equal distance from a neighboring rear curved leg for eliminating electrical arching.

* * * * *